US005823016A

United States Patent [19]

Glotz

[11] Patent Number: 5,823,016

[45] Date of Patent: Oct. 20, 1998

[54] WASHING AND CLEANING DEVICE

[76] Inventor: Karl-Heinz Glotz, Hechtweg 7, D-31275, Lehrte, Germany

[21] Appl. No.: 676,330

[22] PCT Filed: Jan. 13, 1995

[86] PCT No.: PCT/EP95/00119

§ 371 Date: Sep. 23, 1996

§ 102(e) Date: Sep. 23, 1996

[87] PCT Pub. No.: WO95/19732

PCT Pub. Date: Jul. 27, 1995

[30] Foreign Application Priority Data

Jan. 22, 1994 [DE] Germany ..... 44 01 798.7

[51] Int. Cl.[6] ..... B08B 3/10

[52] U.S. Cl. ..... 68/3 SS; 366/128; 366/127; 134/184

[58] Field of Search ..... 134/56 R, 58 R, 134/184; 68/3 SS; 366/127

[56] References Cited

U.S. PATENT DOCUMENTS

| | | |
|---|---|---|
| 2,622,425 | 12/1952 | Harshberger . |
| 3,453,773 | 7/1969 | Compton et al. . |
| 3,466,017 | 9/1969 | Malvin . |
| 3,500,579 | 3/1970 | Bryer . |
| 3,779,238 | 12/1973 | Cutler et al. . |
| 3,985,344 | 10/1976 | McCord . |
| 4,114,194 | 9/1978 | Walter . |
| 5,413,551 | 5/1995 | Wu . |

FOREIGN PATENT DOCUMENTS

| | | |
|---|---|---|
| 1100575 | 6/1952 | France . |
| 1 102 562 | 10/1955 | France . |
| 958865 | 2/1957 | Germany . |
| 28 17 170 | 10/1979 | Germany . |
| 90 02 289 | 5/1990 | Germany . |
| 93 16 089 | 2/1994 | Germany . |
| 609776 | 10/1960 | Italy . |
| 05 068 665 | 3/1993 | Japan . |
| 567 755 | 6/1984 | U.S.S.R. . |
| 1687681 | 10/1991 | U.S.S.R. . |
| 701476 | 12/1953 | United Kingdom . |
| 212099 | 11/1957 | United Kingdom . |

*Primary Examiner*—Frankie L. Stinson
*Attorney, Agent, or Firm*—Shlesinger Arkwright & Garvey LLP

[57] ABSTRACT

A washing and cleaning device comprises a liquid-tight housing inside which an electrically driven means for producing vibrations transferable from said housing to its invironment is arranged. To achieve a device having a simple structure and working effectively and reliably there is provided an electric motor (10) rigidly secured to the inner wall of said housing (2), said electric motor having an output shaft (12) comprising an imbalanced mass (14) outside the axis of rotation to produce vibrations. An accumulator (16) or a power supply unit (24) is provided as a power source for said electric motor (10).

16 Claims, 1 Drawing Sheet

FIG. 1
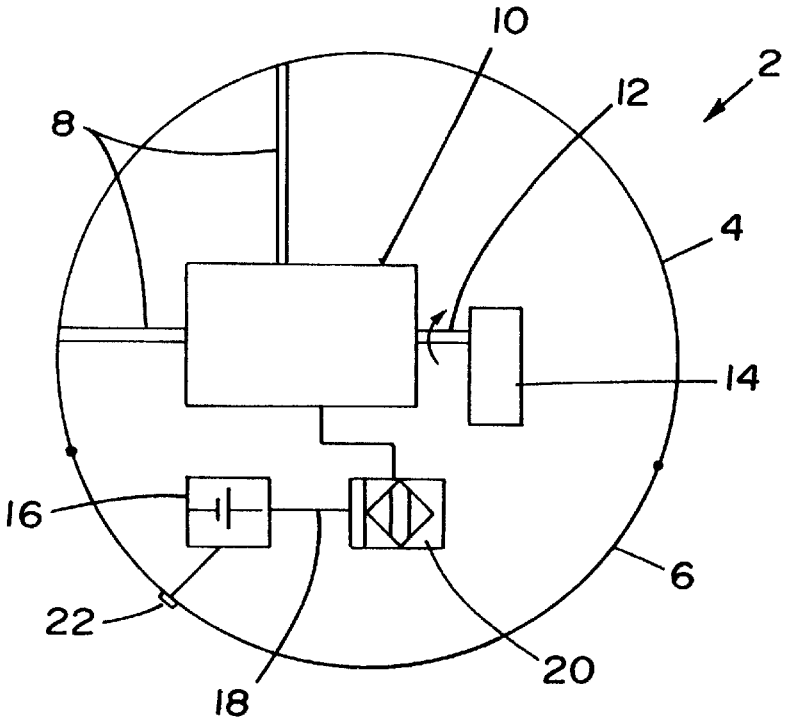
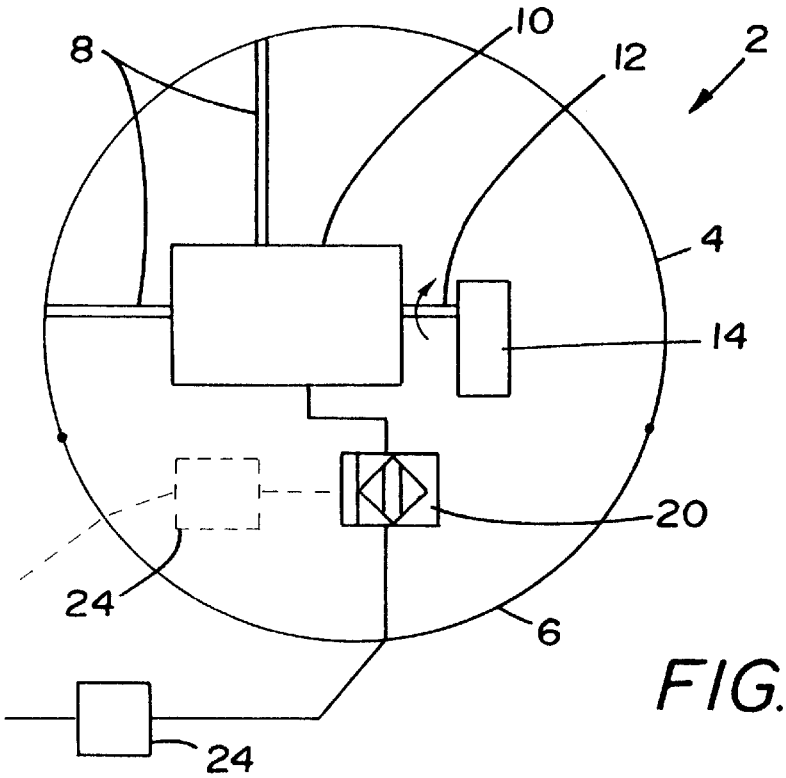
FIG. 2

WASHING AND CLEANING DEVICE

FIELD OF THE INVENTION

The invention concerns a washing and cleaning device of the type including a sealed housing inside of which an electrically driven device for generating vibrations transferable from the housing to its environment is arranged.

BACKGROUND OF THE INVENTION

From DE-Utility Model 90 02 289 a washing and cleaning device operating with an ultrasonic generator arranged inside a housing is known. This device has a cost-intensive structure and does not work very reliably.

OBJECTS AND SUMMARY OF THE INVENTION

It is the object of the present invention to modify a device of the type mentioned above such as to have a simple structure and an effective washing performance, to work reliably, and to be easy to transport and usable in any desired location.

This object is achieved by means of a washing a cleaning device comprising a sealed housing inside of which an electrically driven device for generating vibrations transferable from the housing to its environment is arranged, and having an electric motor arranged in the cavity of the housing and rigidly secured to the inner wall thereof, as well as an imbalanced mass generating the vibrations being arranged outside the axis of rotation and on the output shaft of the electric motor.

Advantageous and expedient modifications of the problem solution of the present invention are as set forth below.

The invention is characterised by a simple structure and virtually does not require any maintenance work. It can be produced at a relatively small size and can be used in just about any location.

BRIEF DESCRIPTION OF THE DRAWINGS

The invention is explained in detail below by making reference to the appended drawing showing embodiments, wherein:

FIG. 1 is a first embodiment of a washing and cleaning device; and

FIG. 2 is a second embodiment of a washing and cleaning device.

Identical reference numerals in the figures of the drawing designate equivalent elements.

DETAILED DESCRIPTION OF THE INVENTION

The drawings show a housing 2 in the form of a hollow sphere composed of two sphere shells 4, 6 sealingly welded together.

The housing 2 contains an electric motor 10 rigidly secured to the housing inner wall e.g. by strut elements 8, with an unbalanced mass or flywheel 14 for generating vibrations being arranged outside the rotation axis and on the output shaft 12 thereof. The electric motor 10 operates at a rotational speed of 8,000–15,000 rpm.

For a power supply, a current source having the form of an accumulator 16 is provided inside the housing—cf. FIG. 1—with a switch 20, preferably a reed switch, arranged on the housing wall being connected along the power line 18 towards the electric motor 10. The accumulator may be re-charged via a connection 22 arranged in or on the housing wall.

Instead of the accumulator, a power supply unit 24—cf. FIG. 2—arranged outside the housing 2 or inside the housing (indicated in broken lines) may also be provided as a current source.

The housing 22 preferably is made up of plastics material and may e.g, have a diameter of 77 mm.

Operation of the described device is carried out as follows. The spherical housing is introduced into the articles to be washed or cleaned with the electric motor switched on. The vibrations generated by the device are transferred to the washing or cleaning liquid and simply and rapidly detach dirt particles from the articles to be washed or cleaned. Adding detergent or soap generally is not required; the washing or cleaning process is, however, accelerated by the addition of detergent or soap. By means of the described device, considerable amounts of detergent may be saved to thus at the same time relieve the strain on the environment caused by detergents.

What is claimed is:

1. A washing and cleaning device, comprising:

a) a sealed housing;

b) an electrically driven device arranged in said housing for generating vibrations transferable from said housing to its environment;

c) an electric motor disposed in a cavity of said housing and rigidly secured to an inner wall thereof;

d) said electrically driven device including an imbalanced mass for generating the vibrations being arranged outside the axis of rotation of and on an output shaft of said electric motor; and e) an accumulator disposed inside said housing and being provided as a power source for said electric motor, said accumulator being rechargeable via a connection being arranged adjacent said housing wall.

2. A device as defined in claim 1, wherein:

a) said housing has the form of a substantially hollow sphere.

3. A device as defined in claim 2, wherein:

a) said substantially hollow sphere includes two sphere shells sealingly welded to each other.

4. A device as defined in claim 1, wherein:

a) a reed switch is provided for switching said electric motor on/off, and said reed switch is located at one of inside and on said housing wall.

5. A device as defined in claim 1, wherein:

a) said electric motor has a rotational speed of about 8,000–15,000 revolutions per minute.

6. A washing and cleaning device, comprising:

a) a sealed housing;

b) an electrically driven device disposed in said housing for generating vibrations transferable from said housing to its environment;

c) an electric motor disposed in a cavity of said housing and secured to an inner wall thereof;

d) said electrically driven device including an imbalanced mass disposed outside the axis of rotation of and on an output shaft of said electric motor for generating the vibrations; and e) an accumulator disposed inside said housing and being provided as a power source for said electric motor.

7. A device as defined in claim 6, wherein:

a) said housing has the form of a substantially hollow sphere.

8. A device as defined in claim 7, wherein:

a) said hollow sphere includes two shells.

9. A device as defined in claim 6, wherein:

a) a reed switch is provided for switching said electric motor on/off.

10. A device as defined in claim 6, wherein:

a) said electric motor has a rotational speed of about 8,000–15,000 revolutions per minute.

11. A washing and cleaning device, comprising:

a) a sealed housing;

b) an electrically driven device disposed in said housing for generating vibrations transferable from said housing to its environment;

c) an electric motor disposed in a cavity of said housing and rigidly secured to an inner wall thereof;

d) said electrically driven device including an imbalanced mass disposed outside the axis of rotation of and on an output shaft of said electric motor for generating the vibrations;

e) a power supply unit is disposed at one of inside and outside said housing, and said power supply unit serves as a power source for said electric motor; and f) said electric motor has a rotational speed of about 8,000–15,000 revolutions per minute.

12. A device as defined in claim 6, wherein:

a) said accumulator is rechargeable via a connection arranged adjacent said housing wall.

13. A device as defined in claim 12, wherein:

a) said connection is disposed on said housing wall.

14. A device as defined in claim 6, wherein:

a) said electric motor is rigidly secured to said inner wall of said housing.

15. A device as defined in claim 14, wherein:

a) said housing has the form of a substantially hollow sphere.

16. A device as defined in claim 14, wherein:

a) a reed switch is provided for switching said electric motor on/off and said reed switch is located at one of inside and on said housing wall.

* * * * *